US009580889B2

(12) United States Patent
Kure

(10) Patent No.: US 9,580,889 B2
(45) Date of Patent: Feb. 28, 2017

(54) WORK VEHICLE

(71) Applicant: KOMATSU LTD., Tokyo (JP)

(72) Inventor: Kazuki Kure, Kishiwada (JP)

(73) Assignee: KOMATSU LTD., Tokyo (JP)

( * ) Notice: Subject to any disclaimer, the term of this patent is extended or adjusted under 35 U.S.C. 154(b) by 478 days.

(21) Appl. No.: 14/345,993

(22) PCT Filed: Sep. 19, 2013

(86) PCT No.: PCT/JP2013/075360
§ 371 (c)(1),
(2) Date: Mar. 20, 2014

(87) PCT Pub. No.: WO2014/192172
PCT Pub. Date: Dec. 4, 2014

(65) Prior Publication Data

US 2016/0251832 A1 Sep. 1, 2016

(51) Int. Cl.
*E02F 9/22* (2006.01)
*F02D 29/02* (2006.01)
(Continued)

(52) U.S. Cl.
CPC ..... *E02F 9/226* (2013.01); *E02F 9/0891* (2013.01); *E02F 9/2066* (2013.01); *E02F 9/2246* (2013.01); *E02F 9/2292* (2013.01); *E02F 9/2296* (2013.01); *F01P 1/06* (2013.01); *F01P 5/04* (2013.01); *F01P 5/043* (2013.01); *F02D 29/02* (2013.01); *F15B 11/08* (2013.01); *E02F 3/7604* (2013.01); *E02F 3/7609* (2013.01); *E02F 9/0866* (2013.01);
(Continued)

(58) Field of Classification Search
CPC ..... F02F 9/0866; F02F 9/2066; F15B 11/08; F01P 1/06; F01P 5/04
See application file for complete search history.

(56) References Cited

U.S. PATENT DOCUMENTS

| | | | | |
|---|---|---|---|---|
| 6,076,488 | A | 6/2000 | Yamagishi | |
| 8,370,051 | B2 * | 2/2013 | Pursifull | F02D 41/042 123/179.4 |
| 2012/0057989 | A1 * | 3/2012 | Cho | E02F 9/0866 417/46 |

FOREIGN PATENT DOCUMENTS

| | | | |
|---|---|---|---|
| CN | 103029569 | A | 4/2013 |
| JP | 2003-065097 | A | 3/2003 |

(Continued)

*Primary Examiner* — John Walters
*Assistant Examiner* — James Triggs
(74) *Attorney, Agent, or Firm* — Drinker Biddle & Reath LLP

(57) ABSTRACT

A work vehicle of the present invention includes an engine, a cooling core, a fan, a hydraulic drive unit, and an idle reduction execution unit. The cooling core is mounted in the work vehicle. The fan is configured to blow air to the cooling core and to be capable of making regular and reverse rotations. The hydraulic drive unit is configured to drive the fan by driving the engine. The idle reduction execution unit is configured to stop the engine based on a state of rotation of the fan caused by the hydraulic drive unit and based on an idle state. The idle reduction execution unit stops the engine on a condition that the fan makes regular rotation and the idle state has continued for a predetermined time, and does not stop the engine on a condition that the fan makes reverse rotation.

7 Claims, 13 Drawing Sheets

(51) Int. Cl.

| | |
|---|---|
| ***F01P 5/04*** | (2006.01) |
| ***E02F 9/20*** | (2006.01) |
| ***F01P 1/06*** | (2006.01) |
| ***F15B 11/08*** | (2006.01) |
| *F02D 29/04* | (2006.01) |
| *E02F 3/76* | (2006.01) |
| *F02N 11/08* | (2006.01) |
| *F01P 11/06* | (2006.01) |
| *E02F 9/08* | (2006.01) |

(52) U.S. Cl.
CPC ..... *F01P 2011/063* (2013.01); *F02D 29/04* (2013.01); *F02N 11/0818* (2013.01); *F15B 2211/66* (2013.01)

(56) References Cited

FOREIGN PATENT DOCUMENTS

| | | |
|---|---|---|
| JP | 2004-197682 A | 7/2004 |
| JP | 2006-057600 A | 3/2006 |

* cited by examiner (C)

| No. | IDLE REDUCTION TIME |
|---|---|
| 1 | OFF |
| 2 | 5MIN |
| 3 | 6MIN |
| 4 | 7MIN |
| 5 | 8MIN |
| 6 | 9MIN |
| 7 | 10MIN |
| 8 | 15MIN |
| 9 | 20MIN |
| 10 | 25MIN |
| 11 | 30MIN |
| 12 | 60MIN |

WORK VEHICLE

TECHNICAL FIELD

The present invention relates to a work vehicle, and particularly relates to a work vehicle having a cooling core.

BACKGROUND ART

A work vehicle such as bulldozer is mounted with a work implement such as blade, a hydraulic pump driven by an engine, a fan driven by a hydraulic oil emitted from the hydraulic pump, and a cooling core for cooling a coolant or the like flowing to the engine, by means of an airflow generated by the fan. By way of example, the cooling core includes a radiator, an oil cooler, or the like.

In the work vehicle configured in this manner, earth/sand and/or grit/dust generated during work may be stirred up and enter the cooling core and the like and, while the work vehicle is kept driven for a long time, earth dirt, grease dirt, and/or other foreign matters may be caught on a top surface of cooling fin serving as a component of the cooling core, which may possibly result in clogging with the dirt sticking to and deposited on the surface. This condition deteriorates the heat dissipation ability of the cooling core, and therefore requires regular cleaning of the cooling core.

Accordingly, there has been proposed a configuration in which the fan is adapted to be capable of reverse rotation and the fan is rotated in the reverse direction to thereby blow off dirt and the like sticking to the cooling core (see for example Japanese Patent Laying-Open No. 2004-197682).

Meanwhile, with the aim of energy saving and environmental protection, there has been a recent demand for incorporation of an idle reduction capability in the work vehicle. The idle reduction capability is a capability of automatically stopping the engine when an idle state of the work vehicle has continued for a predetermined time. The idle state means a state where the work vehicle is kept on standby with the engine running. For example, Japanese Patent Laying-Open No. 2003-65097 proposes a configuration in which the engine in the idle state is stopped when the work vehicle has not been operated for a predetermined time.

CITATION LIST

Patent Document

PTD 1: Japanese Patent Laying-Open No. 2004-197682
PTD 2: Japanese Patent Laying-Open No. 2003-65097

SUMMARY OF INVENTION

Technical Problem

The above-referenced publications each teach that the engine in the idle state is stopped when the work vehicle has not been operated for a predetermined time. If, however, the engine is stopped by the idle reduction capability during cleaning of the cooling core for which the fan is rotated in the reverse direction, the fan driven by the engine is also stopped and accordingly the cleaning of the cooling core is forced to be stopped.

The present invention has been made to solve the above problem, and an object of the invention is to provide a work vehicle capable of effectively cleaning the cooling core.

Other objects and new features will become clear from the description herein and the attached drawings.

Solution to Problem

According to an aspect of the present invention, a work vehicle includes an engine, a cooling core, a fan, a hydraulic drive unit, and an idle reduction execution unit. The cooling core is mounted in the work vehicle. The fan is configured to blow air to the cooling core and to be capable of making regular and reverse rotations. The hydraulic drive unit is configured to drive the fan by driving the engine. The idle reduction execution unit is configured to stop the engine based on a state of rotation of the fan caused by the hydraulic drive unit and based on an idle state. The idle reduction execution unit stops the engine on a condition that the fan makes regular rotation and the idle state has continued for a predetermined time, and does not stop the engine on a condition that the fan makes reverse rotation.

In the work vehicle of the present invention, the engine is stopped in the case where the rotation of the fan is regular rotation and the idle state has continued for a predetermined time, and the engine is not stopped in the case where rotation of the fan is reverse rotation. Thus, in the case where rotation of the fan is reverse rotation, the engine is not stopped. Therefore, while the cooling core is cleaned by means of air blowing in the reverse direction to the cooling core for removing dirt and the like which has caused clogging, the engine is inhibited from being stopped and accordingly the cooling core can effectively be cleaned.

Preferably, the work vehicle further includes a cab and a control panel. The control panel is provided in the cab and configured to receive an instruction given by an operator to make reverse rotation of the fan. The hydraulic drive unit drives the fan so that the fan makes reverse rotation, when the control panel receives the instruction to make reverse rotation of the fan.

According to the foregoing, the control panel is provided in the cab and an instruction to make reverse rotation of the fan that is given by an operator is received through the control panel. Thus, the operator can give, in a simple and easy manner, an instruction to perform the cleaning capability by which the fan is caused to make reverse rotation.

Preferably, the hydraulic drive unit includes a hydraulic motor, a hydraulic pump, a switch valve, and an adjustment unit. The hydraulic motor is configured to drive the fan. The hydraulic pump is configured to supply a hydraulic oil to the hydraulic motor by being driven by the engine. The switch valve is configured to switch a path through which the hydraulic oil is flown to the hydraulic motor. The adjustment unit is configured to adjust a supply amount of the hydraulic oil supplied from the hydraulic pump to the hydraulic motor.

According to the foregoing, the path through which the hydraulic oil is flown can be switched by the switch valve to thereby easily reverse the rotation of the fan.

In particular, rotation speed of the regular and reverse rotations of the fan is adapted to be variable depending on the supply amount of the hydraulic oil supplied from the hydraulic pump to the hydraulic motor. The adjustment unit adjusts the supply amount of the hydraulic oil supplied from the hydraulic pump to the hydraulic motor so that the rotation speed of the fan is a maximum rotation speed in a case where the fan makes reverse rotation.

According to the foregoing, the supply amount of the hydraulic oil is adjusted so that the rotation speed of the fan is a maximum rotation speed in the case of reverse rotation of the fan. Thus, in the case of the cleaning capability by which the fan is caused to make reverse rotation, air of the maximum amount is blown to the cooling core and therefore the time for cleaning can be shortened.

Preferably, the work vehicle further includes a detection unit. The detection unit is configured to detect a state of operation of the work vehicle. The idle reduction execution unit stops the engine on a condition that the detection unit detects that the state of operation of the work vehicle is a state where the work vehicle is not operated, the fan makes regular rotation, and the idle state has continued for a predetermined time, and does not stop the engine on a condition that the fan makes reverse rotation.

According to the foregoing, in the case where the state of operation of the work vehicle is a state where the work vehicle is not operated, the fan makes regular rotation, and the idle state has continued for a predetermine time, the engine is stopped. In the case where the fan makes reverse rotation, the engine is not stopped. Thus, in the case where the work vehicle is being operated, the engine is not stopped, so that the work vehicle can smoothly be operated.

Preferably, the work vehicle further includes a sensor configured to detect a temperature of a coolant of the engine or a temperature of a hydraulic oil. The idle reduction execution unit stops the engine on a condition that the temperature of the coolant of the engine or the temperature of the hydraulic oil detected by the sensor is in a predetermined range, the fan makes regular rotation, and the idle state has continued for a predetermined time, and does not stop the engine on a condition that the fan makes reverse rotation.

According to the foregoing, in the case where the temperature of the coolant of the engine or the temperature of the hydraulic oil detected by the sensor is in a predetermined range, the fan makes regular rotation, and the idle state has continued for a predetermined time, the engine is stopped. In the case where the fan makes reverse rotation, the engine is not stopped. Thus, in the case where the temperature of the coolant of the engine or the temperature of the hydraulic oil is out of a predetermined range, the engine is not stopped, and therefore, the engine is not stopped in the case where it is not desired to stop the engine because the temperature is out of a predetermined range, so that the work vehicle can smoothly be operated.

Preferably, the work vehicle further includes a cover arranged to cover the engine, the cooling core, and the fan. The cover includes a side cover capable of opening to expose a side of at least one of the engine, the cooling core, and the fan, when the fan makes reverse rotation.

According to the foregoing, the cover includes a side cover capable of opening to expose a side of at least one of the engine, the cooling core, and the fan while the fan makes a reverse rotation. Thus, with the side cover opened, the fan can be caused to make reverse rotation to thereby easily discharge dirt to the outside and thus efficiently clean the cooling core.

Advantageous Effects of Invention

As seen from the description above, the work vehicle of the present invention is capable of effectively cleaning the cooling core.

DESCRIPTION OF EMBODIMENTS

In the following, an embodiment of the present invention will be described based on the drawings. The present embodiment will be described mainly with reference to a bulldozer as an example of the work vehicle.

<Overall Configuration>

Figure 1:
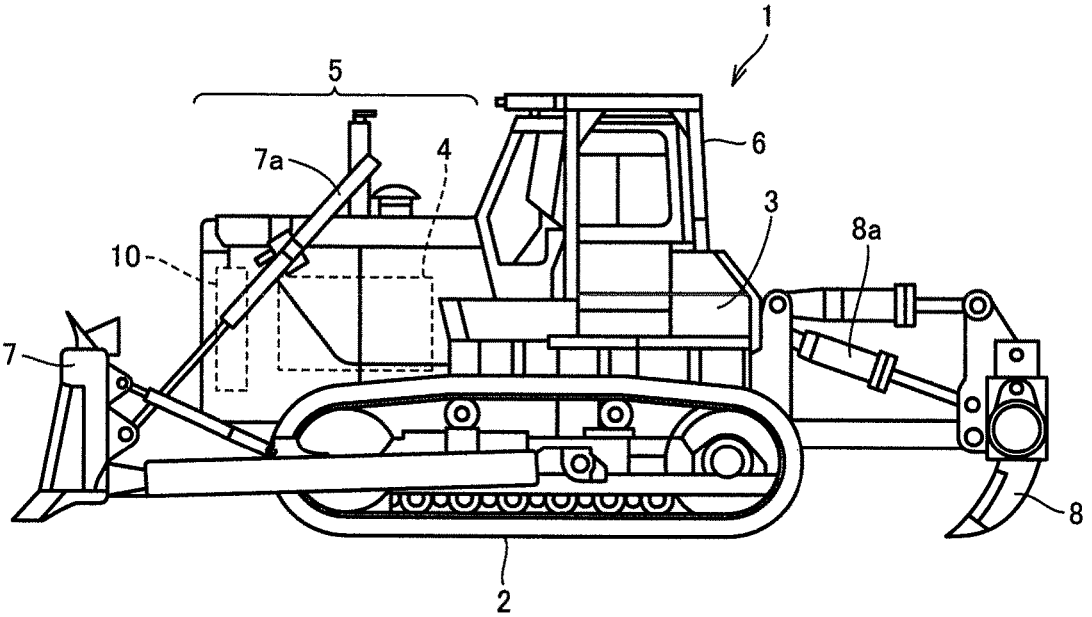
FIG. 1 is a side view of a bulldozer 1.

FIG. 1 is a side view of a bulldozer 1.

As shown in FIG. 1, bulldozer 1 includes a traveling unit 2, a body 3, a blade 7, a ripper 8, and a cab 6.

Body 3 is provided on traveling unit 2.

Traveling unit 2 is provided under body 3 in such a manner that enables traveling unit 2 to travel, and has a pair of endless belts rotated to enable the traveling unit to travel on an irregular ground.

Body 3 is mounted with an engine 4 and a cooling core 10.

Engine 4 is provided in an engine compartment located in a front portion of body 3. By way of example, engine 4 is a diesel engine.

Cooling core 10 includes at least one of a radiator which is used for cooling a coolant of engine 4, an oil cooler which cools a hydraulic oil, and the like.

Body 3 includes a cover 5, and cover 5 is provided to cover engine 4, cooling core 10, a fan blowing air toward cooling core 10 as will be described later herein. A part of cover 5 has a side cover adapted to be openable and closable as will be described later herein.

Cab 6 is disposed so that it is located centrally but relatively closer to the rear side of body 3.

Blade 7 is mounted to serve as a work implement located frontward relative to body 3, for digging the ground and pushing and carrying resultant earth/sand. Blade 7 is actuated by hydraulic cylinders 7*a* in accordance with operation of a blade control lever as will be described later herein.

Ripper 8 is mounted to serve as a work implement located rearward relative to body 3. Ripper 8 has its leading end mounted with a ripper point which extends vertically downward to be thrust in a rock or the like for cutting or crushing the rock by means of a traction force given by traveling unit 2. Like blade 7, ripper 8 is actuated by hydraulic cylinders 8*a* in accordance with operation of a ripper control lever as will be described later herein. In general, lift cylinders for raising and lowering ripper 8 as well as tilt cylinders for moving forward and backward the leading end of ripper 8 are provided.

In cab 6, an operator seat (driver seat) for an operator to sit thereon, levers and pedals used for various operations, gauges, and the like are installed.

<Configuration of Cab 6>

Figure 2:
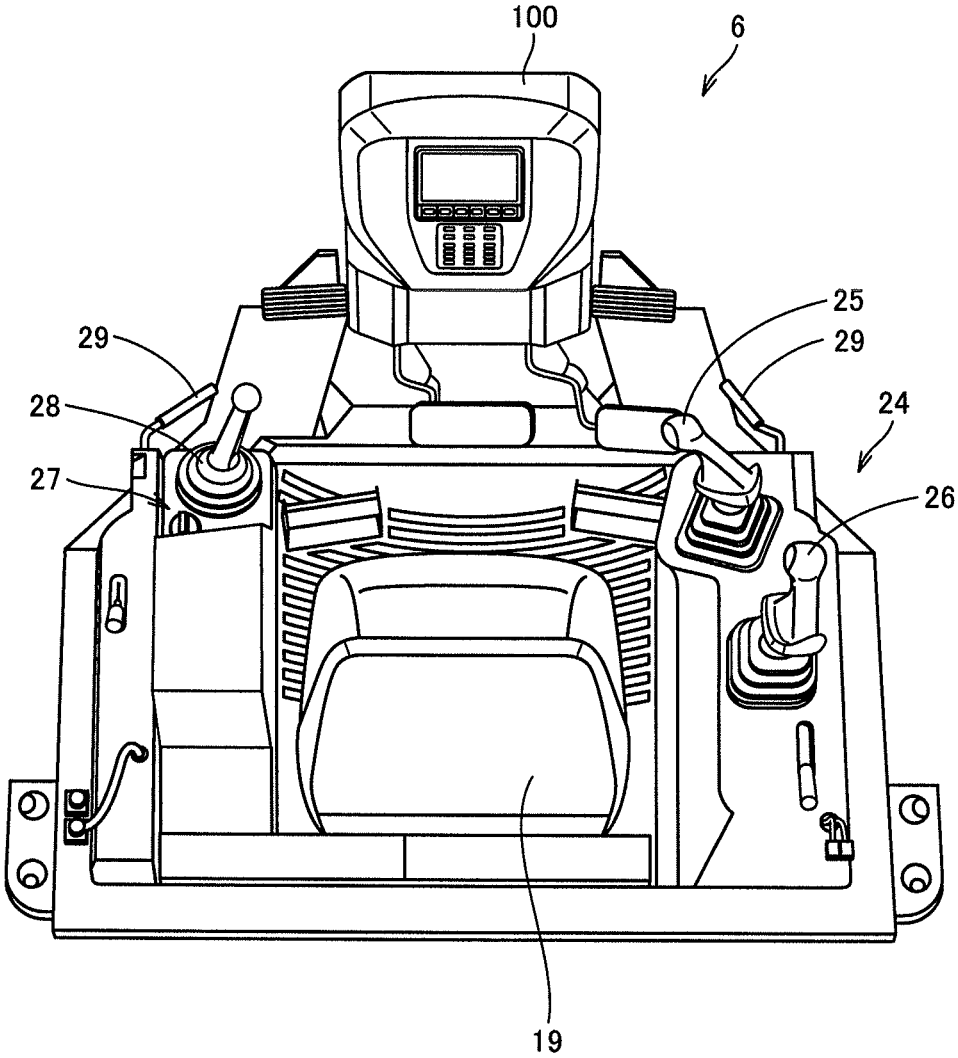
FIG. 2 is a perspective view showing an internal configuration of a cab 6.

FIG. 2 is a perspective view showing an internal configuration of cab 6.

As shown in FIG. 2, cab 6 includes an operator seat 19, a right control device 24, a left control device 27, a control panel 100, a lock lever 29, and the like.

Operator seat 19 is a seat for an operator who gets on/off the cab to sit thereon for performing operation, and operator seat 19 is mounted in such a manner that enables the seat to slide forward and backward. Operator seat 19 is also mounted in such a manner that enables the seat to rotate in order to improve the ease of operation when the operator is operating ripper 8 or the like with the operator's face directed rearward.

In front of operator seat 19, control panel 100 is mounted that can be operated by the operator sitting on the seat. The operator can operate control panel 100 to make various settings and the like for bulldozer 1. Control panel 100 is configured to inform the operator of the engine state of the bulldozer and to be able to receive instructions about settings for various operations. The engine state refers for example to the temperature of the engine coolant, the temperature of the hydraulic oil, the remaining amount of fuel, and the like. The instructions about settings for various operations are instructions about settings for the idle reduction capability, instructions about the cleaning capability for the cooling core, and the like.

On the right and left sides of operator seat 19, controllers such as a control lever to be operated by the operator are mounted.

Right control device 24 is disposed on the right side of operator seat 19 relative to an operator sitting on operator seat 19. On the top surface of right control device 24, a blade control lever 25, a ripper control lever 26, and the like are mounted.

Left control device 27 is disposed on the left side of operator seat 19 relative to an operator sitting on operator seat 19. On the top surface of left control device 27, a travel control lever 28 and the like are mounted. Travel control lever 28 is swung frontward and rearward where "frontward" is the forward direction in which the vehicle travels, and also swung rightward and leftward, for the sake of steering.

Lock levers 29 are mounted in the vicinity of travel control lever 28 and blade control lever 25, respectively. In the present embodiment, the right and left lock levers 29 are connected to each other by way of example. Thus, as one of the levers is moved upward/downward, the other is similarly moved. Regarding the present embodiment, lock levers 29 are described as being provided on both sides, respectively. Instead, lock levers 29 may be provided on one side only. Here, lock lever 29 refers to a device for stopping operation of a work implement (blade 7, ripper 8), and stopping traveling unit 2 from traveling, for example. Namely, an operation of positioning lock lever 29 at its lowered position (operation of lowering the lock lever) can be done to lock (restrict) movement of the work implement and the like. In the state where movement of the work implement and the like is locked by lock lever 29, the work implement and the like do not work even if the operator operates blade control lever 25, travel control lever 28, or the like.

<Configuration of Hydraulic Drive System>

Next, a hydraulic drive system of bulldozer 1 will be described.

Figure 3:
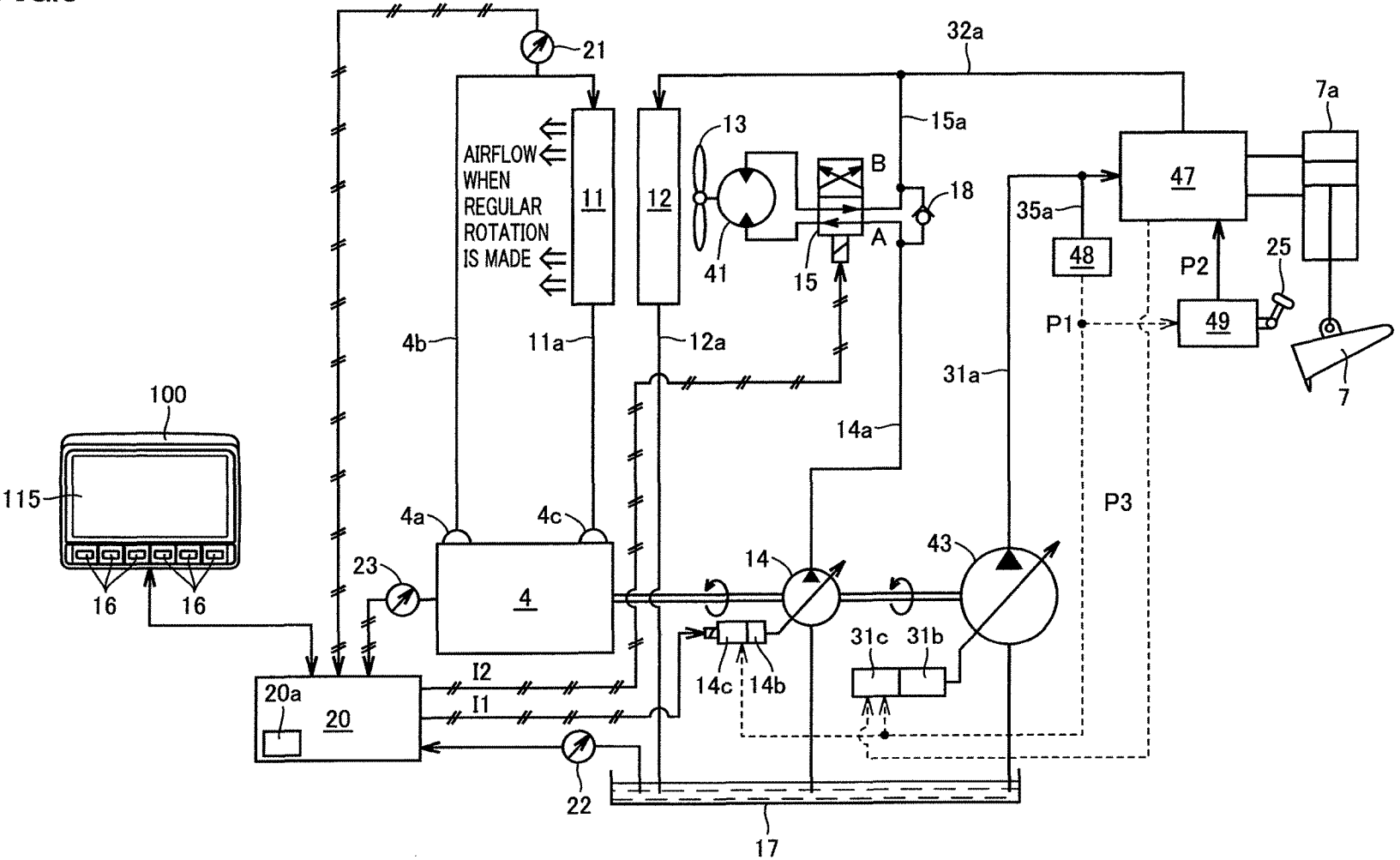
FIG. 3 is a circuit diagram of a hydraulic drive system of bulldozer 1.

FIG. 3 is a circuit diagram of the hydraulic drive system of bulldozer 1.

As shown in FIG. 3, the drive system of bulldozer 1 includes blade 7, engine 4, a water pump 4*a*, a water jacket 4*c*, a radiator 11, hydraulic pumps 14, 43, an electromagnetic switching valve 15, a hydraulic motor 41, a fan 13, an oil cooler 12, conduits 4*b*, 11*a*, 12*a*, 14*a*, 15*a*, 31*a*, 32*a*, 35*a*, a check valve 18, a hydraulic oil tank 17, a hydraulic oil temperature sensor 22, a controller 20, servo valves 14*b*, 31*b*, an electromagnetic proportional valve 14*c*, a pressure reducing valve 48, a control valve 47, hydraulic cylinder 7*a*, a pilot pressure control valve 49, blade control lever 25, a load sensing valve 31*c*, a coolant temperature sensor 21, an engine rotation sensor 23, and control panel 100.

Engine 4 drives hydraulic pumps 14, 43 of the variable displacement type.

The hydraulic oil emitted from hydraulic pump 14 is flown through conduit 14*a* into an input port of electromagnetic switch valve 15, and fed by electromagnetic switch valve 15 to hydraulic motor 41 of the fixed displacement type.

To the output rotational shaft of hydraulic motor 41, fan 13 is rotatably attached. The oil returned from hydraulic motor 41 is flown through electromagnetic switch valve 15, conduit 15*a*, and conduit 32*a* to enter oil cooler 12, cooled by oil cooler 12, and flown through conduit 12*a* to return to hydraulic oil tank 17 and thereby form a circulation circuit.

Between conduit 14*a* and conduit 15*a*, check valve 18 is connected for circulating the oil of hydraulic motor 41 rotated by inertia when hydraulic pump 14 and hydraulic motor 41 are stopped.

Hydraulic oil tank 17 is provided with hydraulic oil temperature sensor 22 for detecting the temperature of the hydraulic oil. The detection signal of hydraulic oil temperature sensor 22 is input to controller 20.

Hydraulic pump 14 has its output controlled by operation of servo valve 14*b* so that the amount of emission is varied. Change of the variable amount of emission, namely the amount of the fed hydraulic oil is changed to control the rotation speed of fan 13.

Electromagnetic proportional valve 14*c* receives a control pressure P1 from pressure reducing valve 48, and outputs to servo valve 14*b* a pilot pressure in accordance with a command current value I1 from controller 20. Servo valve 14*b* is configured to control the tilt angle of a swash plate of hydraulic pump 14 based on this pilot pressure.

Electromagnetic switch valve 15 is a dual-position valve which is switched to Position A or Position B in response to a switch signal I2 from controller 20 to thereby control the direction of the output flow and control hydraulic motor 41, namely fan 13 so that it can make regular rotation and reverse rotation. In the present embodiment, by way of example, fan 13 makes regular rotation when electromagnetic switch valve 15 is at Position A and makes reverse rotation when it is at Position B.

For a work implement (blade 7 by way of example here) shown in FIG. 1, hydraulic pump 43 of the variable displacement type is driven by engine 4.

The hydraulic oil emitted from hydraulic pump 43 is flown through conduit 31*a* to enter control valve 47, and then fed to hydraulic cylinder 7*a* by operation of control valve 47. Extension/contraction of hydraulic cylinders 7*a* actuate blade 7 to move upward/downward. The oil returned from hydraulic cylinders 7*a* is flown through control valve 47 and conduit 32*a* to enter oil cooler 12, cooled by oil cooler 12, and flown through conduit 12*a* to return to hydraulic oil tank 17 and thereby form a circulation circuit.

Pilot pressure control valve 49 receives control pressure P1 from pressure reducing valve 48 provided on a branch of conduit 31*a*, and outputs a pilot pressure P2 in accordance with the extent to which blade control lever 25 is operated. Control valve 47 is configured to feed to hydraulic cylinder 7*a* the emitted oil of an amount in accordance with pilot pressure P2 from pilot pressure control valve 49. Hydraulic pump 43 has its amount of emission controlled by operation of servo valve 31*b*, and the variable amount of emission is used to control the speed of hydraulic cylinder 7*a*. Load sensing valve (LS valve) 31*c* receives a load pressure P3 from control valve 47 and control pressure P1 from pressure reducing valve 48, and outputs a pilot pressure to servo valve 31*b*. Servo valve 31*b* is configured to control, based on this pilot pressure, the tilt angle of a swash plate of hydraulic pump 43.

Regarding the present embodiment, the manner has been described in which blade 7 is driven through extension/contraction of hydraulic cylinders 7*a* caused by blade control lever 25. Ripper 8 is also driven in a similar manner (not shown) through extension/contraction of hydraulic cylinders 8*a* caused by ripper control lever 26.

The coolant emitted from water pump 4*a* of engine 4 is flown through conduit 4*b* to enter radiator 11, cooled by radiator 11, and flown through conduit 11*a* to return to water jacket 4*c* of engine 4 and thereby form a circulation circuit.

Engine 4 is provided with engine rotation sensor 23 for detecting the rotation speed of engine 4. Conduit 4*b* at the inlet of radiator 11 is provided with coolant temperature sensor 21 for detecting the temperature of the coolant of engine 4. Respective detection signals of these sensors are input to controller 20.

Controller 20 is a controller controlling the whole of bulldozer 1, and includes a CPU (Central Processing Unit), a nonvolatile memory, a timer, and the like. It also includes a storage unit 20*a* in which control data and the like are stored.

Controller 20 is configured to perform, based on respective detection signals obtained through detection by coolant temperature sensor 21, hydraulic oil temperature sensor 22, and engine rotation sensor 23, a predetermined arithmetic operation, as will be described later herein, to determine command current value I1 specifying a rotation speed of fan 13, and output this command current value I1 to electromagnetic proportional valve 14*c*.

Controller 20 also outputs, to electromagnetic switch valve 15, switch signal I2 which controls the regular and reverse rotations of the fan, in accordance with an instruction from control panel 100 as will be described later herein.

<Fan Control>

Figure 4:
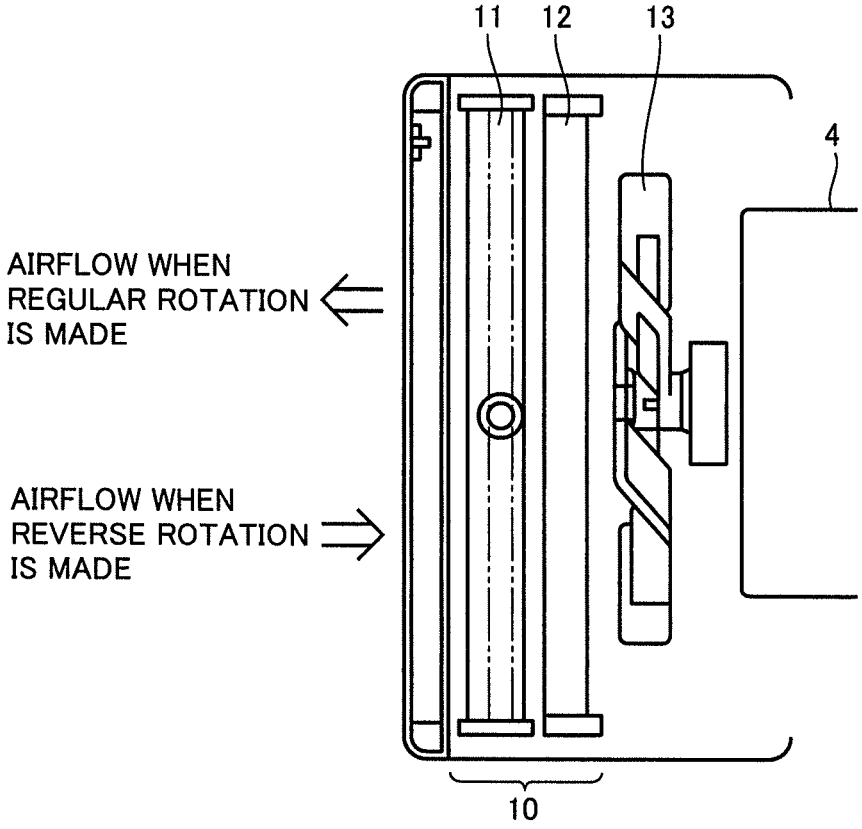
FIG. 4 is a diagram illustrating arrangement of a cooling core 10 in the vicinity of a fan.

FIG. 4 is a diagram illustrating arrangement of cooling core 10 in the vicinity of the fan.

Referring to FIG. 4, cooling core 10 includes radiator 11 and oil cooler 12. Cooling core 10 and fan 13 are arranged frontward with respect to engine 4. Radiator 11 cools the coolant of engine 4. Oil cooler 12 cools the hydraulic oil of the hydraulic drive system described above. Fan 13 is driven by hydraulic motor 13 which is driven by pressurized oil emitted from hydraulic pump 14 driven by engine 4, and makes regular and reverse rotations to thereby blow air to cooling core 10 including radiator 11 and oil cooler 12. Fan 13 can thus blow air to cooling core 10 and thereby increase the efficiency in cooling the coolant and the hydraulic oil. In the present embodiment, fan 13 is configured to be capable of making reverse rotation, and the reverse rotation of fan 13 can reverse the direction in which air is blown to cooling core 10, as will be described later herein. While engine 4 outputs motive power, fan 13 is being caused to make regular rotation or reverse rotation, and is therefore not stopped.

Next, calculation of the rotation speed of fan 13 will be described.

Regarding the present embodiment, control in the case of regular rotation of fan 13 will be described.

Figure 5:
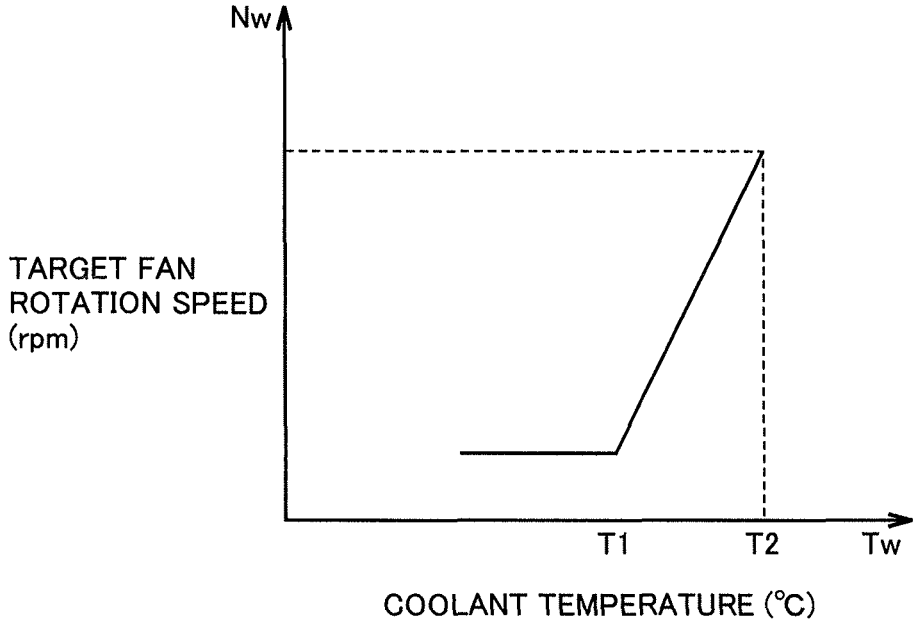
FIG. 5 is a diagram illustrating a relationship between a coolant temperature Tw and a target fan rotation speed Nw.

FIG. 5 is a diagram illustrating a relationship between a coolant temperature Tw and a target fan rotation speed Nw.

As shown in FIG. 5, target fan rotation speed Nw is adjusted in accordance with coolant temperature Tw. Regarding the present embodiment, a case is illustrated where target fan rotation speed Nw is kept at a certain target fan rotation speed until coolant temperature Tw reaches T1 and, as coolant temperature Tw increases from T1 to T2, target fan rotation speed Nw is accordingly increased linearly.

Specifically, controller 20 calculates target fan rotation speed Nw corresponding to a detection signal obtained through detection by coolant temperature sensor 21. This operation is executed by a fan control unit 50 of controller 20 as will be described later herein. The same is applied as well to the following fan control.

Figure 6:
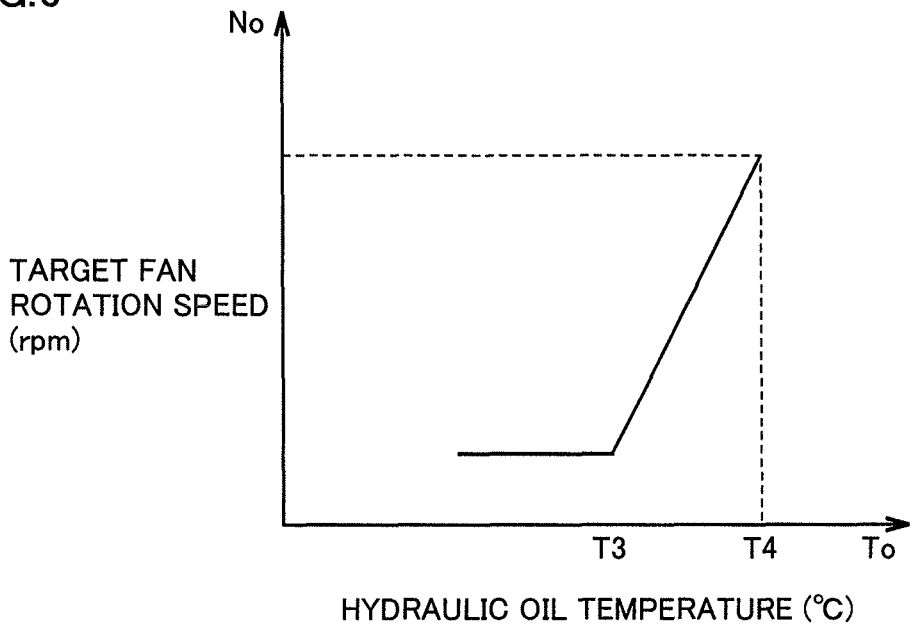
FIG. 6 is a diagram illustrating a relationship between a hydraulic oil temperature To and a target fan rotation speed No.

FIG. 6 is a diagram illustrating a relationship between a hydraulic oil temperature To and a target fan rotation speed No.

As shown in FIG. 6, target fan rotation speed No is adjusted in accordance with hydraulic oil temperature To. Regarding the present embodiment, a case is illustrated where target fan rotation speed No is kept at a certain target fan rotation speed until hydraulic oil temperature To reaches T3 and, as hydraulic oil temperature To increases from T3 to T4, target fan rotation speed No is accordingly increased linearly.

Specifically, controller 20 calculates target fan rotation speed No corresponding to a detection signal obtained through detection by hydraulic oil temperature sensor 22.

Figure 7:
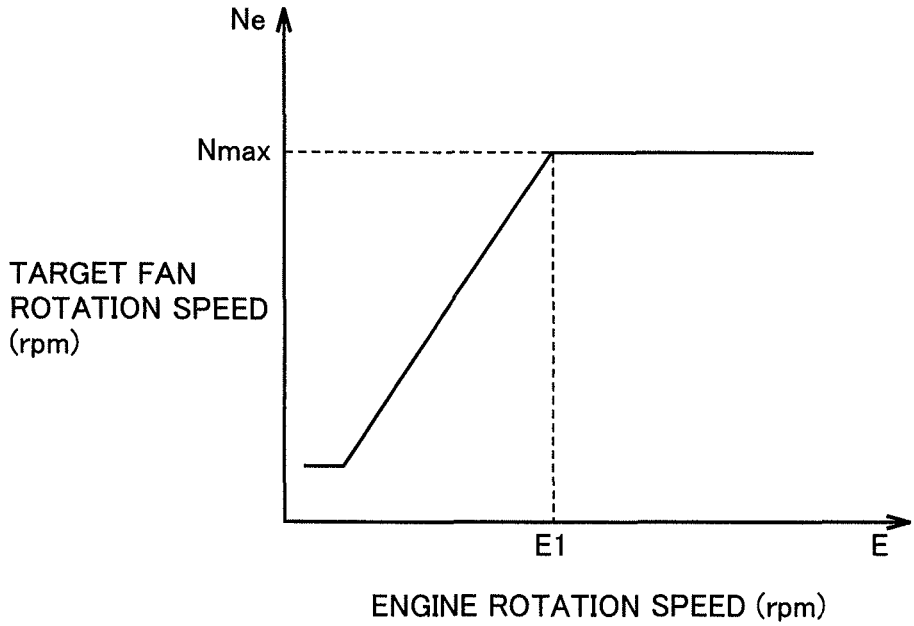
FIG. 7 is a diagram illustrating a relationship between an engine rotation speed E and a target fan rotation speed Ne.

FIG. 7 is a diagram illustrating a relationship between an engine rotation speed E and a target fan rotation speed Ne.

As shown in FIG. 7, target fan rotation speed Ne is adjusted in accordance with engine rotation speed E. Regarding the present embodiment, a case is illustrated where target fan rotation speed Ne is kept at a certain value when engine rotation speed E is relatively low and, as engine rotation speed E increases, target fan rotation speed Ne is accordingly increased. It should be noted that, regarding the present embodiment, the case is illustrated where the target fan rotation speed is kept at a maximum rotation speed (Nmax) when engine rotation speed E is a predetermined rotation speed E1 or higher.

Specifically, controller 20 calculates target fan rotation speed Ne corresponding to a detection signal obtained through detection by engine rotation sensor 23.

Based on target fan rotation speeds Nw, No, Ne calculated in the above-described way, controller 20 calculates command current value I1 specifying a rotation speed of fan 13. Specifically, based on the maximum rotation speed among the calculated target fan rotation speeds Nw, No, Ne, controller 20 calculates command current value I1 to be specified. Controller 20 then outputs the calculated command current value I1 to electromagnetic proportional valve 14*c*. Thus, in accordance with respective results of detection by the sensors, the amount of air to be blown from fan 13 to cooling core 10 can be adjusted to thereby achieve efficient cooling of cooling core 10.

Regarding the present embodiment, the description has been given, by way of example, of the manner of adjustment in which the rotation speed of fan 13 is adjusted to the maximum rotation speed among target fan rotation speeds Nw, No, Ne. This manner of adjustment, however, is merely an exemplary one. For example, command current value I1 to be specified may be calculated in accordance with the average rotation speed of target fan rotation speeds Nw, No, Ne. Alternatively, a target fan rotation speed may be selected based on predetermined conditions. In this respect, it is possible for those skilled in the art to appropriately make a design change to a proper manner of adjustment based on information regarding characteristics of bulldozer 1.

It should be noted that control data used for calculating the target fan rotation speed in above-referenced FIGS. 5 to 7 for example is stored in advance in storage unit 20*a*. The data may be acquired from an externally given input or through communication with an external server.

<Configuration of Control Panel 100>

Next, a configuration of control panel 100 will be described.

Figure 8:
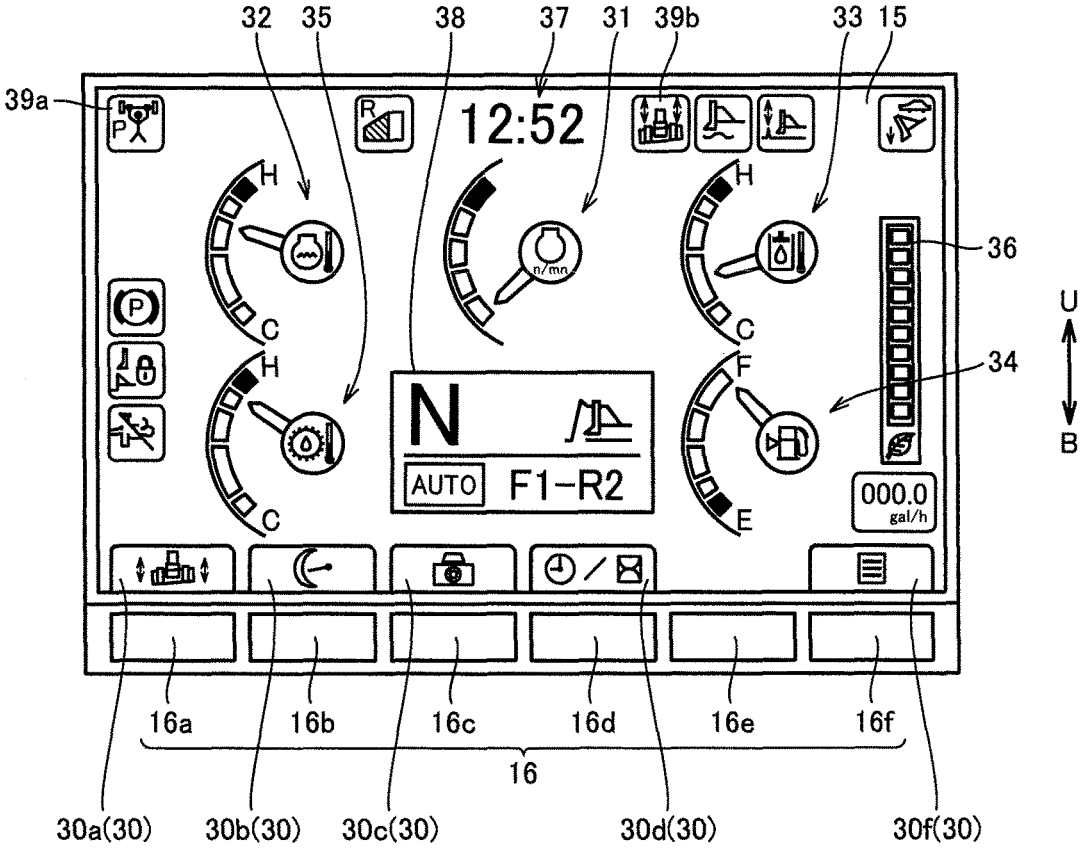
FIG. 8 is a diagram showing an example standard screen indicating information about an engine state and displayed on a display 115 of a control panel 100.

FIG. 8 is a diagram showing an example standard screen indicating information about an engine state and displayed on a display 115 of control panel 100.

As shown in FIG. 8, indication is given in the form of an icon on display 115 so that an operator can visually recognize it easily even while operating bulldozer 1.

An icon represents an object/matter by a symbol with a simple picture or pattern. In the present embodiment, together with a plurality of icons, various data represented by numerical values are indicated on display 115.

The top of or the upward direction with respect to display 115 corresponds to the ceiling side of cab 6 which is indicated by an arrowhead U, and the bottom of or the downward direction with respect to display 115 corresponds to the floor side of cab 6 which is indicated by an arrowhead B.

Under display 115, a plurality of (six in this example) function switches 16*a*, 16*b*, 16*c*, 16*d*, 16*e*, 16*f* are arranged. In the case where the function switches are collectively referred to, they are denoted by a reference character 16. In the case where the function switches are separately referred to, they are denoted respectively by reference characters such as 16*a*, 16*b*. In a bottom area within the screen of display 115, function guides 30*a*, 30*b*, 30*c*, 30*d*, 30*f* serving as guide indices are displayed at respective positions corresponding to function switches 16*a*, 16*b*, 16*c*, 16*d*, 16*e*, 16*f*. In the case where the function guides are collectively referred to, they are denoted by a reference character 30. In the case where the function guides are separately referred to, they are denoted by respective reference characters such as 30*a*, 30*b*.

While a plurality of function switches 16 are arranged under display 115, a plurality of function switches 16 may be arranged in an area other than the illustrated one. For example, a plurality of function switches 16 may be arranged in a side area or a top area with respect to display 115. In this case, in the screen of display 115, a plurality of function guides 30 are indicated at respective positions corresponding respectively to function switches 16. In the case for example where a plurality of function switches 16 are arranged in a side area with respect to display 115, a plurality of function guides 30 are indicated in a lateral end area in the screen of display 115, in association of respective function switches 16.

Function guides 30 are each an index indicating the function of corresponding function switch 16. In the present embodiment, function guide 30 is indicated in the form of an icon on display 115. Namely, each function guide 30 indicates in the foul' of an icon what function the corresponding function switch 16 has. A function is assigned to the screen displaying each of function guides 30.

Function guide 30 enables an operator to intuitionally recognize the function of function switch 16 to select a desired function switch 16. In addition, function guide 30 indicates the function of function switch 16 to thereby improve the ease of visual recognition by an operator.

In the present embodiment, display 115 indicates five meter-type gauge icons. These are a multigauge 31, an engine water temperature gauge 32, a hydraulic oil temperature gauge 33, a fuel gauge 34, and a transmission oil temperature gauge 35. These icons each have a pointer and an arc-shaped scale, and the pointer is turned to indicate a quantity of the corresponding gauge. In addition, display 115 indicates an energy saving gauge 36 showing the state of energy saving drive based on fuel consumption, a clock 37 indicating time, a state indicator 38 indicating the current state of bulldozer 1 such as state of travel of bulldozer 1, as well as function display icons 39*a*, 39*b* indicating functions of bulldozer 1, and the like.

Multigauge 31 is an indicator indicating information about different engine states by making a switch by means of function switch 16. In the present embodiment, in response to operation of function switch 16*b*, multigauge 31 can change the information about the engine state which is displayed by the multigauge.

For example, in the example shown in FIG. 8, the multigauge indicates the rotation speed (number of revolutions per unit time) of engine 4 mounted on bulldozer 1. In response to operation of function switch 16*b* corresponding to function guide 30*b*, multigauge 31 may be switched to indicate the traction force, for example. By way of example, other types of information indicated by multigauge 31 include the hydraulic oil pressure, the engine oil pressure, the battery voltage, the traction force, the vehicle speed, the clock, and the engine rotation speed. In the present embodiment, each time function switch 16*b* is operated once, the information indicated by multigauge 31 may be switched one by one.

<Functional Block Diagram>

Figure 9:
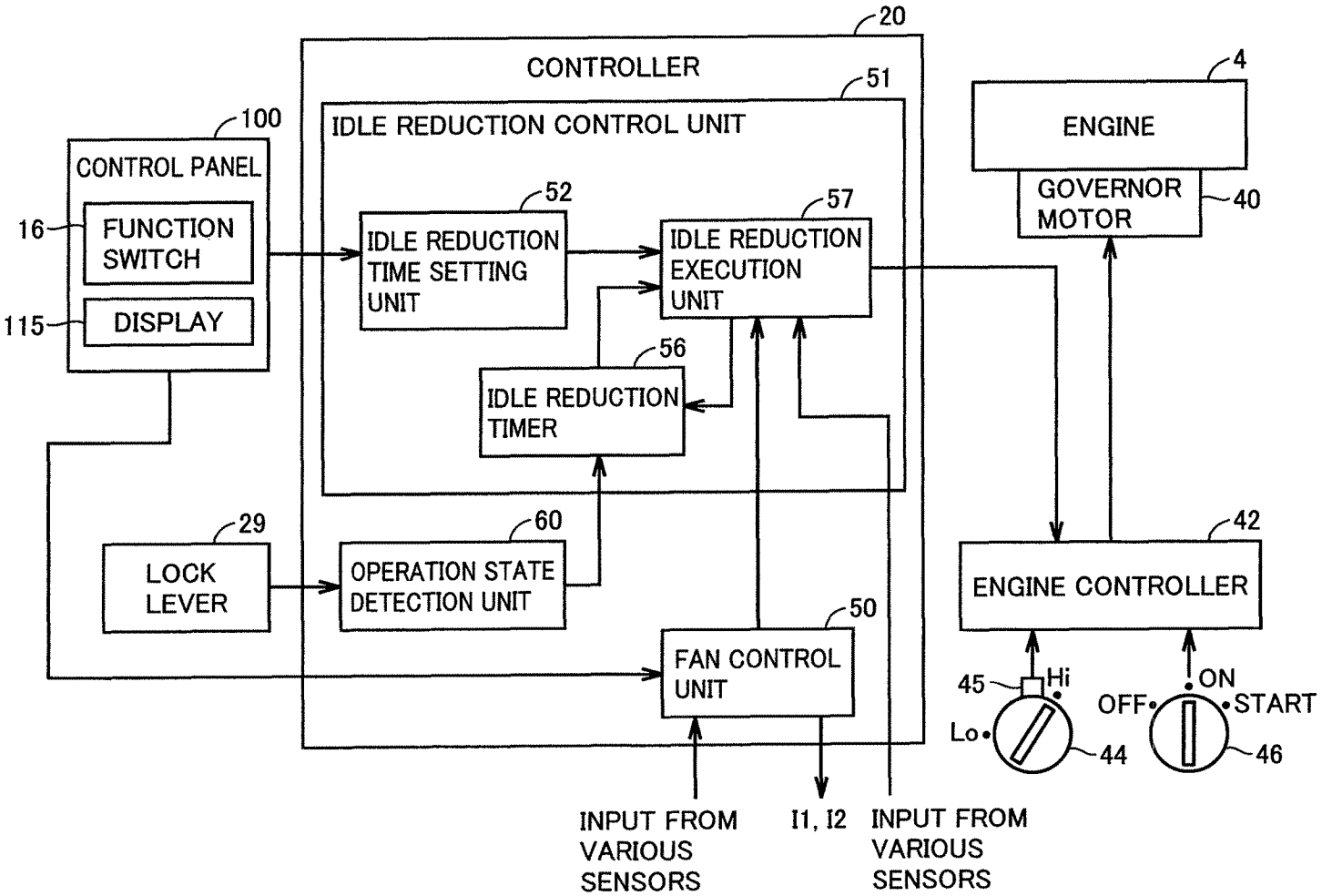
FIG. 9 is a diagram illustrating functional blocks of a control system including a controller 20 of bulldozer 1.

FIG. 9 is a diagram illustrating functional blocks of a control system including controller 20 of bulldozer 1.

As shown in FIG. 9, controller 20 has the illustrated relationships with peripheral devices. Here, the illustrated peripheral devices are control panel 100, lock lever 29, engine 4, a governor motor 40, an engine controller 42, a fuel dial 44, a potentiometer 45, and a starter switch 46.

Governor motor 40 adjusts the amount of fuel injected by a fuel injector in engine 4.

Engine controller 42 controls the operation of engine 4. By way of example, engine 4 is a diesel engine. The engine rotation speed of engine 4 is set by fuel dial 44 or the like.

Fuel dial 44 is provided with potentiometer 45. Potentiometer 45 detects the extent to which fuel dial 44 is operated and outputs, to engine controller 42, a value of a dial command (also referred to as dial command value) concerning the rotation speed of engine 4. In accordance with the dial command value of fuel dial 44, a target rotation speed of engine 4 is adjusted.

Engine controller 42 follows an instruction from controller 20 and, based on the dial command value regarding the rotation speed of engine 4 which is determined in accordance with the extent to which the dial is operated that is given from potentiometer 45, controller 42 instructs governor motor 40 to adjust the rotation speed of engine 4 by controlling the amount of fuel injected by the fuel injector.

Starter switch 46 is connected to engine controller 42. In response to operator's operation of starter switch 46 (the switch is set to START), a start signal is output to engine controller 42 and accordingly engine 4 is started.

The dial command value from fuel dial 44 and the start signal from starter switch 46 may also be input through engine controller 42 to controller 20.

Controller 20 includes an idle reduction control unit 51, a fan control unit 50, and an operation state detection unit 60.

Idle reduction control unit 51 controls an idle reduction operation.

Fan control unit 50 controls rotation of fan 13.

Operation state detection unit 60 detects the state of operation of a variety of control levers and the like.

Idle reduction control unit 51 includes an idle reduction time setting unit 52, an idle reduction timer 56, and an idle reduction execution unit 57.

Idle reduction time setting unit 52 sets an idle reduction time which is a condition on which idle reduction execution unit 57 executes the idle reduction in accordance with an operation instruction by means of function switch 16 of control panel 100.

Idle reduction execution unit 57 outputs an engine stop signal to engine controller 42 so that an idle reduction operation of stopping engine 4 when a predetermined condition is satisfied is executed. "Idle reduction operation" means an operation of stopping an idle state of the work vehicle, namely stopping engine 4 in a state where the work vehicle is kept on a standby state with engine 4 running. The predetermined condition is a condition on which "idle reduction operation" is executed, and chiefly means a condition regarding a predetermined time for which the idle state of the work vehicle continues.

In the present embodiment, this "predetermined time" is also referred to as idle reduction time.

Idle reduction timer 56 is a timer which counts (clocks) the time, in accordance with an instruction from operation state detection unit 60. Timer 56 then outputs the result of counting to idle reduction execution unit 57. Idle reduction execution unit 57 determines, based on the result of counting (timer value) by idle reduction timer 56, whether or not the idle reduction time has passed. When it determines that the idle reduction time has passed, it outputs an engine stop signal to engine controller 42. Receiving the engine stop signal from idle reduction execution unit 57, engine controller 42 instructs governor motor 40 to stop engine 4 and accordingly the engine is stopped.

Fan control unit 50 calculates a target fan rotation speed based on input of the detection signals from various sensors as described above in connection with FIGS. 5 to 7, and outputs command current value I1 accordingly. In addition, following an instruction given from control panel 100, fan control unit 50 outputs switch signal I2 for switching rotation of fan 13 to regular or reverse rotation. Moreover, fan control unit 50 outputs a signal to idle reduction control unit 51 as required.

Operation state detection unit 60 detects a state of operation of various control levers for example. In the present embodiment, specifically the detection unit detects a state of operation of lock lever 29. Following an operation of lowering lock lever 29 (toward the lock position), the operation of various control levers is locked. Thus, under the state where lock lever 29 locks operation of the work implement and the like, the work implement and the like is not operated even when the operator operates blade control lever 25, travel control lever 28, or the like.

In addition, when lock lever 29 is operated toward the lock position, operation state detection unit 60 detects this operation and gives an instruction to idle reduction timer 56. Accordingly, control of the idle reduction operation is started.

<Setting of Idle Reduction Time>

Figure 10:
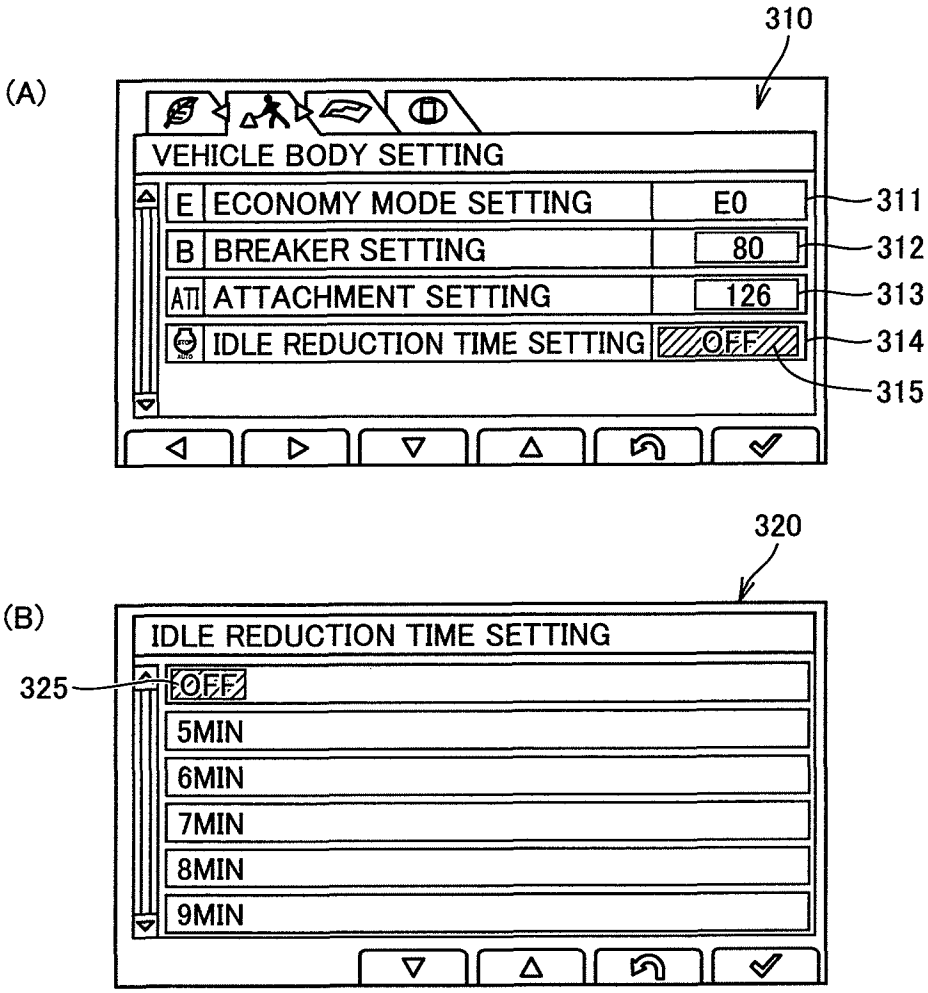
FIG. 10 is a diagram for illustrating how an idle reduction time is set.

FIG. 10 is a diagram for illustrating how the idle reduction time is set.

In FIG. 10 (A), an exemplary user mode screen is shown.

This user mode screen is displayed in response to selection of a function switch 16 which corresponds to a predetermined function guide 30 in the above-described standard screen indicated on display 115. By way of example, in response to operation of function switch 16*f*, the user mode screen is displayed.

In the present embodiment, there is displayed a vehicle body setting screen 310 which is included in the user mode screen and can be used to make settings for the vehicle body.

In this vehicle body setting screen 310, there are shown items including "economy mode setting" 311 with which details of an economy mode among an operation mode are set, "breaker setting" 312 with which details of a breaker mode are set, "attachment setting" 313 with which details of an attachment mode are set, and "idle reduction time setting" 314 with which the idle reduction time is set that is a condition on which the idle reduction operation is executed.

An operator selects an instruction switch provided in a bottom area of the screen to operate a cursor 315 and make a selection so that details of the item corresponding to the position of cursor 315 can be set.

Regarding the present embodiment, a description will be given of the case where cursor 315 is used to make a selection for the item relevant to the idle reduction time setting. In the present embodiment, there is shown the case where the idle reduction time is set "OFF."

As shown in FIG. 10 (B), an idle reduction time setting screen 320 is shown. In vehicle body setting screen 310 described above, cursor 315 is moved to the item "idle reduction time setting" 314 indicated on display 115, and a function switch for making a selection is pressed to thereby cause idle reduction time setting screen 320 to be displayed.

Idle reduction time setting screen 320 is configured so that the idle reduction time can be set to any of a plurality of idle reduction times. In the present embodiment, there is shown a range in which the idle reduction time can selectively be set, namely "OFF" and "5 min" to "9 min." It should be noted that cursor 325 can further be moved downward to set the idle reduction time to a time longer than "9 min."

An operator can operate cursor 325 to make a selection and thereby set the idle reduction time to a desired one. Namely, from control panel 100 to idle reduction time setting unit 52, information about the set idle reduction time is input, and the idle reduction time is accordingly set by idle reduction time setting unit 52.

As shown in FIG. 10 (C), a setting table used for setting the idle reduction time is shown.

Here, there is illustrated by way of example the setting table that can be used to set the idle reduction time to any of 12 patterns, and the longest time to which the idle reduction time can be set is "60 minutes."

While the above description is of an interface used for setting the idle reduction time in the present embodiment, namely an interface where the idle reduction time is set to the one which is selected from a plurality of candidates, setting of the idle reduction time is not limited to this. For example, an interface may be used where a time bar defining the maximum idle reduction time and a cursor which can be moved to any position with respect to the time bar are displayed and the idle reduction time is set by moving the cursor to a desired position with respect to the time bar. Alternatively, in order to set the idle reduction time to any time, an operator may input a numerical value to set the idle reduction time to the input time.

<Setting of Cleaning Mode>

As to the capabilities of the work vehicle in the present embodiment, the work vehicle has, in addition to the idle reduction capability, a cleaning capability (cleaning mode) for cleaning cooling core 10. The cleaning mode is a capability of cleaning the cooling core in the case where earth/sand and/or grit/dust generated during work are stirred up and enter the cooling core and the like. Specifically, this capability is different from a maintenance process in which maintenance, check, and the like are done with engine 4 stopped. Namely, in accordance with an instruction from an operator, engine 4 is driven to rotate fan 13 in the reverse direction. Accordingly, the direction in which air is blown to cooling core 10 is reversed relative to the direction when the fan makes regular rotation to thereby remove foreign matters with which the cooling fin serving as a component of the cooling core is clogged.

Figure 11:
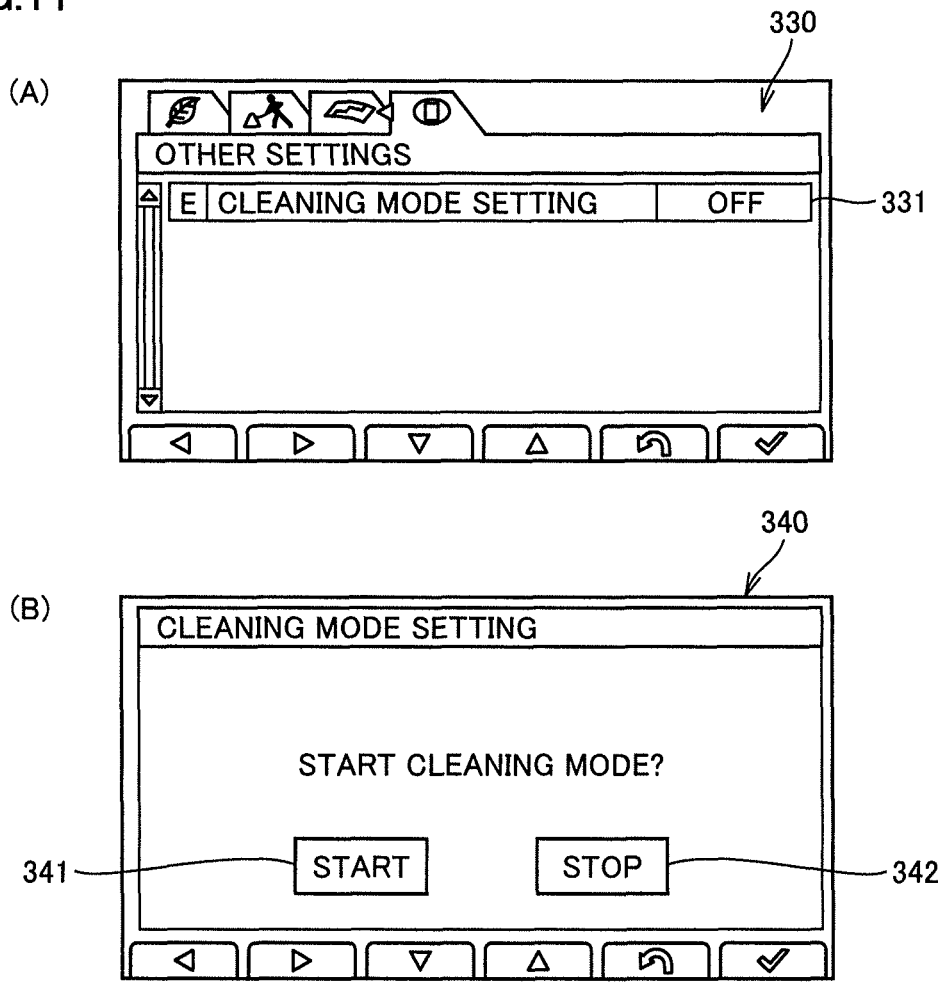
FIG. 11 is a diagram illustrating how a cleaning mode is set.

FIG. 11 is a diagram for illustrating how the cleaning mode is set.

In FIG. 11 (A), an example of how the cleaning mode is set is shown.

This user mode screen is displayed in response to selection of a function switch 16 which corresponds to a predetermined function guide 30 in the above-described standard screen indicated on display 115. By way of example, in response to operation of function switch 16*f*, the user mode screen is displayed.

In the present embodiment, there is displayed a screen for other settings 330 which is included in the user mode screen and can be used to make settings for the cleaning mode.

In the screen for other settings 330, an "ON"/"OFF" icon 331 is given to indicate whether or not the cleaning mode has been started.

In this state, function switch 16 is selected and icon 331 is executed to cause a cleaning mode setting screen 340 in FIG. 11 (B) to be displayed.

In cleaning mode setting screen 340 of FIG. 11 (B), in addition to indication of guidance "START CLEANING MODE?", icons 341, 342 are provided so that "START" or "STOP" of the cleaning mode can selectively be received.

For example, a cursor is placed on icon 341 for selecting it and thus setting the cleaning mode "ON." Accordingly, the cleaning mode is started. Specifically, in accordance with an instruction from control panel 100, an instruction to start the cleaning mode is input to fan control unit 50.

Following the instruction given from control panel 100, fan control unit 50 outputs switch signal I2 to electromagnetic switch valve 15. Accordingly, electromagnetic switch valve 15 switches to Position B in response to switch signal I2 to thereby cause fan 13 to make reverse rotation.

Further, in accordance with an instruction from control panel 100, fan control unit 50 outputs, to electromagnetic proportional valve 14*c*, command current value I1 which specifies the rotation speed of fan 13. In the present embodiment, in the case where fan 13 is to be rotated in the reverse direction, command current value I1 is output so that the rotation speed of the fan is the maximum rotation speed. In this way, cleaning can reliably and effectively be executed faster. Namely, the time for cleaning can be shortened.

In addition, fan control unit 50 informs idle reduction execution unit 57 of the fact that the cleaning mode has been started. In response to this information, the idle reduction operation during the cleaning mode can be inhibited as will be described later herein.

As described above, in bulldozer 1 which is kept driven for a long time, earth dirt, grease dirt, and/or other foreign matters may be caught on a top surface of cooling fin serving as a component of the cooling core, which may possibly result in clogging with the dirt sticking to and deposited on the surface. This condition deteriorates the heat dissipation ability of the cooling core, and therefore requires regular cleaning of the cooling core.

Accordingly, the cleaning capability is used to rotate the fan in the reverse direction and thereby blow off the dirt and the like sticking to cooling core 10 such as radiator and/or oil cooler. In other words, the direction in which air is blown by fan 13 to the cooling core is reversed so that cleaning can be done by removing the dirt and the like which has caused clogging.

After the cleaning mode is started, an operator can instruct, through control panel 100, fan control unit 50 to stop the cleaning mode.

Specifically, from cleaning mode setting screen 340, icon 342 through which "STOP" of the cleaning mode can selectively be received can be selected to give the instruction to stop the cleaning mode.

In the present embodiment, idle reduction execution unit 57 causes the operation of idle reduction timer 56 to stop, in the case where the cleaning mode is started. Namely, idle reduction timer 56 stops counting the time for which the idle state continues. Since the count value of idle reduction timer 56 remains the same, there is no passage of the idle reduction time, and thus idle reduction execution unit 57 does not output the engine stop signal to engine controller 42.

Thus, in the case where the cleaning mode has been started, engine 4 is not caused to stop by the idle reduction operation, and therefore, the cleaning mode can be continued. Namely, the reverse rotation of fan 13 is continued until completion of the cleaning. Cooling core 10 can therefore be cleaned effectively.

Further, after the start of the cleaning mode, selection of function switch 16 to thereby execute "STOP" of the cleaning mode causes the cleaning mode to be set to "OFF." Accordingly, the cleaning mode is ended.

Following an instruction from control panel 100, fan control unit 50 outputs switch signal I2 to electromagnetic switch valve 15. Accordingly, electromagnetic switch valve 15 switches to Position A in response to switch signal I2 to thereby stop the reverse rotation of fan 13 and cause fan 13 to make regular rotation.

In addition, fan control unit 50 informs idle reduction execution unit 57 of the fact that the cleaning mode has been ended in accordance with an instruction given from control panel 100 to stop the cleaning mode. In response to this information, idle reduction execution unit 57 causes idle reduction timer 56 to restart clocking. Idle reduction execution unit 57 executes the idle reduction operation of stopping engine 4 in the case where a predetermined condition for execution of the idle reduction operation is met when the time for which the idle state continues reaches the idle reduction time, in accordance with the count value given by idle reduction timer 56. Namely, idle reduction execution unit 57 outputs the engine stop signal to engine controller 42.

Regarding the present embodiment, a description is given by way of example concerning the case where the cleaning mode is ended by selection of function switch 16 after the start of the cleaning mode, so that "STOP" of the cleaning mode is executed. The manner of ending the cleaning mode is not particularly limited to this, and the cleaning mode may automatically be ended after a predetermined time has passed. In addition, those skilled in the art can appropriately set the predetermined time to a proper time, and the predetermined time may be changed depending on the state of cleaning of cooling core 10. For example, based on the result of detection of a sensor which detects dirt, the predetermined time may be changed. Alternatively, the cleaning mode may be continued, based on the result of detection of the sensor, until the level of detection has become a predetermined detection level or less.

<Idle Reduction Control Process>

Figure 12:
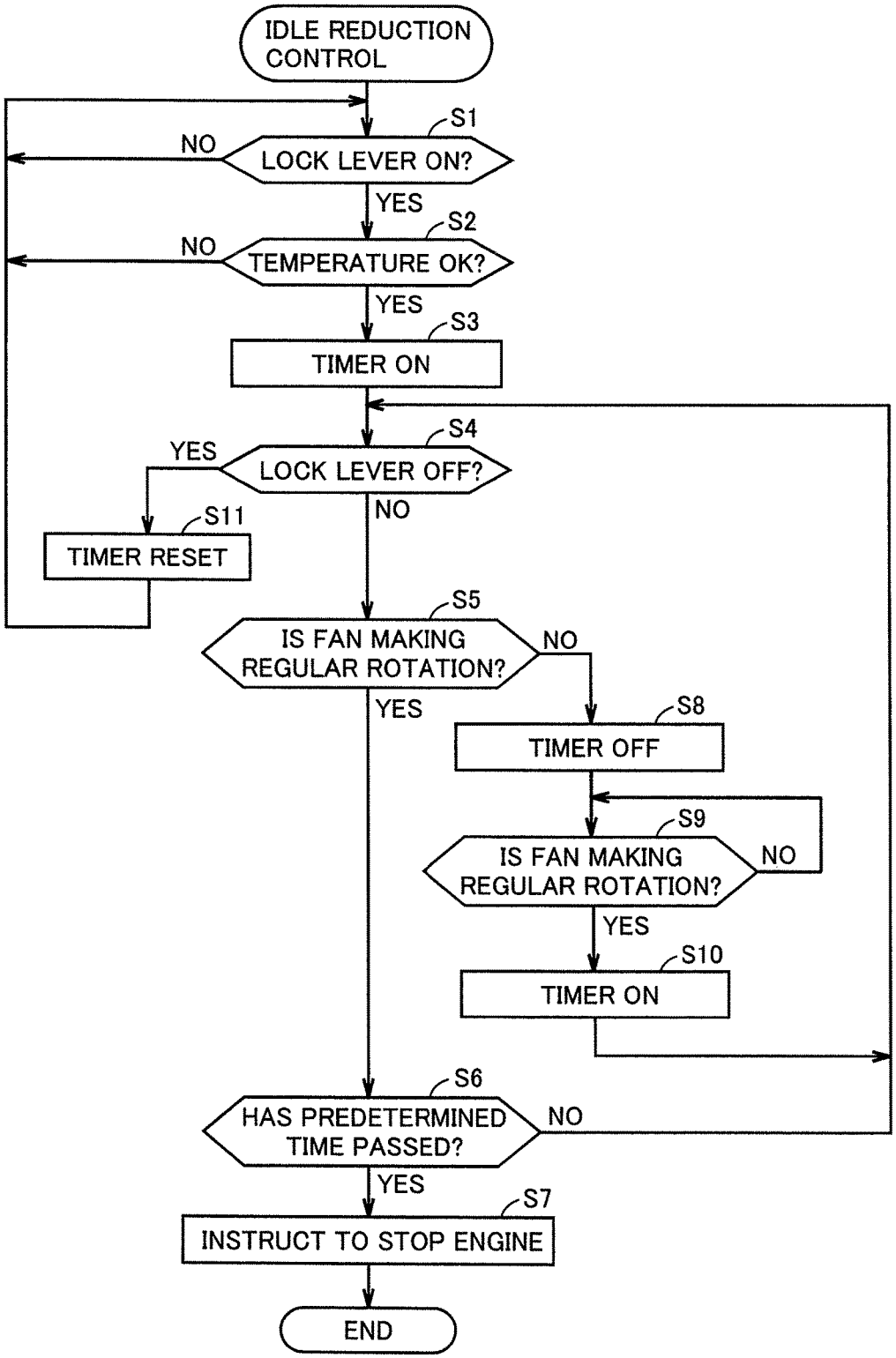
FIG. 12 is a flowchart of an idle reduction control process of an idle reduction control unit 51.

FIG. 12 is a flowchart of an idle reduction control process of idle reduction control unit 51.

As shown in FIG. 12, idle reduction control unit 51 determines whether or not lock lever 29 has been locked (ON) (step S1). Specifically, operation state detection unit 60 detects that lock lever 29 has been locked and outputs a detection signal to idle reduction timer 56. Based on the detection signal which is input from operation state detection unit 60, idle reduction timer 56 determines that lock lever 29 has been locked (ON).

In the case where idle reduction control unit 51 determines in step S1 that lock lever 29 has been locked (ON) (YES in step S1), idle reduction control unit 51 determines whether or not the temperature of the coolant or the hydraulic oil is in a predetermined range (step S2). Specifically, based on detection signals that are input from various sensors, idle reduction execution unit 57 determines whether or not the temperature of the coolant or the hydraulic oil is in a predetermined range.

In the case where idle reduction control unit 51 determines in step S2 that the temperature of the coolant or the hydraulic oil is not in a predetermined range (NO in step S2), idle reduction control unit 51 does not start the idle reduction timer and returns to step S1. Namely, in the case where the temperature of the coolant or the hydraulic oil is not in a predetermined range, the idle reduction operation is not executed. The fact that the temperature of the coolant or the hydraulic oil is not in a predetermined range is specifically that it is necessary, in the case for example of cold weather regions, to raise the temperature of the coolant or the hydraulic oil by warm-up operation. Therefore, during the warm-up operation, the idle reduction operation may not be executed so that the work vehicle is set is in a stable state which enables the work vehicle to smoothly operate. In contrast, in the case for example where the temperature of the coolant or the hydraulic oil is high, rotation of fan 13 for example is used to lower the temperature of the coolant or the hydraulic oil and the work vehicle is stopped under the condition that the temperature is in a predetermined range, so that the internal devices of the work vehicle can be protected. It is possible for those skilled in the art to make a design change of the predetermined range to an appropriate range, based on information about characteristics of bulldozer 1. In addition, it is unnecessary that a predetermined range of the coolant temperature and a predetermined range of the hydraulic oil temperature be identical to each other, and they may be changed depending on respective characteristics. While the description is given regarding the present embodiment of the case where it is determined whether the temperature of the coolant or the hydraulic oil is in a predetermined range, it may alternatively be determined whether one of the temperatures or both the temperatures is or are in a predetermined range.

In the case where idle reduction control unit 51 determines in step S2 that the temperature of the coolant or the hydraulic oil is in a predetermined range (YES in step S2), idle reduction control unit 51 causes idle reduction timer 56 to start (TIMER ON) (step S3). Specifically, idle reduction execution unit 57 instructs idle reduction timer 56 to count the time in accordance with a detection signal which is input from operation state detection unit 60. Then, idle reduction timer 56 outputs the counted timer value to idle reduction execution unit 57.

Next, idle reduction control unit 51 determines whether or not lock lever 29 has been made off (OFF) (step S4). Specifically, operation state detection unit 60 detects that lock lever 29 has been released (OFF), and outputs a detection signal to idle reduction timer 56. Idle reduction timer 56 then determines, based on the detection signal which is input from operation state detection unit 60, lock lever 29 has been released.

In the case where idle reduction control unit 51 determines in step S4 that lock lever 29 has been released (YES in step S4), idle reduction control unit 51 resets idle reduction timer 56 (step S11). Specifically, based on the input detection signal, idle reduction timer 56 stops counting the time and resets the counter value.

Idle reduction control unit 51 then returns to step S1 and waits until lock lever 29 is locked (ON) again.

In contrast, in the case where idle reduction control unit 51 determines in step S4 that lock lever 29 has not been released (NO in step S4), it proceeds to the next step S5.

Then, idle reduction control unit 51 determines whether or not the fan makes regular rotation (step S5). Specifically, idle reduction execution unit 57 determines whether or not it has been informed by fan control unit 50 of the fact that the cleaning mode has been started. In the case where idle reduction execution unit 57 has not been informed by fan control unit 50 of the fact that the cleaning mode has been started, it determines that the fan makes regular rotation and, in the case where idle reduction execution unit 57 has been informed by fan control unit 50 of the fact that the cleaning mode has been started, it determines that the fan makes reverse rotation.

In the case where idle reduction control unit 51 determines in step S5 that the fan makes regular rotation (YES in step S5), it determines whether or not a predetermined time has passed (step S6). Specifically, idle reduction execution unit 57 determines, based on the idle reduction time which is a predetermined time set by idle reduction time setting unit 52 and based on the timer value which is input from idle reduction timer 56, whether or not the timer value has exceeded the idle reduction time. When the timer value has exceeded the idle reduction time, idle reduction execution unit 57 determines that the predetermined time has passed.

In the case where idle reduction control unit 51 determines in step S6 that the predetermined time has passed (YES in step S6), it outputs an instruction to stop the engine (step S7). Specifically, idle reduction execution unit 57 outputs an engine stop signal to engine controller 42. Accordingly, engine controller 42 instructs governor motor 40 to stop engine 4 and accordingly the engine is stopped.

Then, idle reduction control unit 51 ends the process (END).

Through this process, energy consumption and the noise can be reduced by automatically stopping engine 4 of bulldozer 1 in the case where the idle state of bulldozer 1 has continued for a predetermined time.

In contrast, in the case where idle reduction control unit 51 determines in step S6 that the predetermined time has not passed (NO in step S6), it returns to step S4 and repeats the above process until the predetermined time has passed.

In the case where idle reduction control unit 51 determines in step S5 that the fan does not make regular rotation (NO in step S5), idle reduction control unit 51 causes idle reduction timer 56 to stop (TIMER OFF) (step S8). Specifically, in the case where it is determined that the fan does not make regular rotation, i.e., the fan makes reverse rotation, namely idle reduction execution unit 57 has been informed by fan control unit 50 of the fact that the cleaning mode has been started, idle reduction execution unit 57 instructs idle reduction timer 56 to stop counting the time and accordingly it stops counting the time.

Then, idle reduction control unit 51 determines whether or not the fan makes regular rotation (step S9). Specifically, idle reduction execution unit 57 determines whether or not the fan makes regular rotation, namely whether or not it has been informed by fan control unit 50 of the fact that the cleaning mode has been ended. In the case where idle reduction execution unit 57 is informed, after the start of the cleaning mode, by fan control unit 50 of the fact that the cleaning mode has been ended, it determines that the fan has stopped making reverse rotation and now makes regular rotation. In contrast, in the case where idle reduction execution unit 57 has not been informed by fan control unit 50 of the fact that the cleaning mode has been ended, it determines that the fan has not stopped making reverse rotation, namely the fan is making reverse rotation.

In the case where idle reduction control unit 51 determines in step S9 that the fan does not make regular rotation (NO in step S9), the current state is maintained.

In contrast, in the case where idle reduction control unit 51 determines in step S9 that the fan makes regular rotation (YES in step S9), it causes idle reduction timer 56 to restart (TIMER ON) (step S10). Specifically, idle reduction execution unit 57 instructs idle reduction timer 56 to restart counting the time in accordance with the detection signal which is input from operation state detection unit 60. Then, idle reduction timer 56 outputs the counted timer value to idle reduction execution unit 57.

Then, idle reduction control unit 51 returns to step S4 and repeats the above process until a predetermined time has passed.

In this process, namely in the case where the cleaning mode is stated under the condition that the idle state of bulldozer 1 continues and idle reduction timer 56 has started counting (clocking), idle reduction timer 56 is stopped from counting until the cleaning mode is ended.

Thus, until the cleaning mode is ended, idle reduction timer 56 keeps stopping counting and therefore engine 4 of bulldozer 1 is not caused to stop by the idle reduction operation. Namely, in the case where the cleaning mode in which the fan makes reverse rotation is being executed, control is performed so that the idle reduction operation is not executed until the cleaning mode is ended. Thus, after the cleaning mode is started, the cleaning mode can be continued since there is no stoppage of engine 4 by the idle reduction operation. In other words, reverse rotation of fan 13 is continued until cleaning is completed. Cooling core 10 can therefore be cleaned effectively.

When the cleaning mode in which the fan makes reverse rotation is ended, idle reduction timer 56 restarts counting and, when the idle state has continued for a predetermined time, engine 4 of bulldozer 1 is stopped by the idle reduction operation. Thus, when the cleaning mode is ended, idle reduction timer 56 restarts counting so that control is performed to prevent the idle state from continuing for a period more than necessary. Thus, energy consumption and noise can be reduced.

Regarding the present embodiment, it has been described that idle reduction timer 56 is restarted when it is determined in step S9 that the fan makes regular rotation. It is essentially possible as well to reset the counter value.

<Others>

Figure 13:
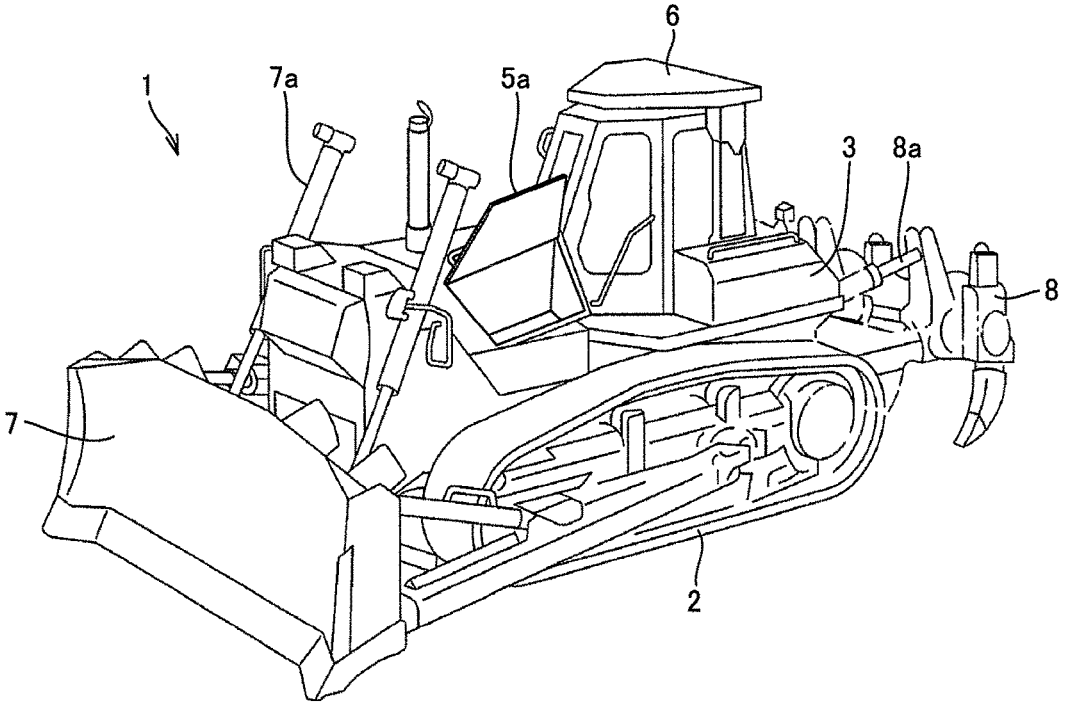
FIG. 13 is a diagram illustrating a form of a side cover provided on bulldozer 1.

FIG. 13 is a diagram illustrating a form of a side cover provided on bulldozer 1.

Referring to FIG. 13, cover 5 is provided with a side cover 5*a*.

Side cover 5*a* is provided in association with the side portion of at least one of cooling core 10, fan 13, and engine 4. In the present embodiment, one side cover 5*a* is illustrated as being provided on one side of bulldozer 1. Instead, side covers 5*a* may be provided on both sides, respectively.

Side cover 5*a* in the present embodiment is of gull-wing type, and is capable of opening and closing to expose the inside of the cover. Side cover 5*a* is not limited to the gull-wing type and may be of any form as long as side cover 5*a* is disposed so that it can be opened and closed.

In the present embodiment, side cover 5*a* can be opened while fan 13 is making reverse rotation.

Accordingly, in the cleaning mode in which fan 13 makes reverse rotation, air is blown to cooling core 10 as fan 13 is making reverse rotation, and dirt can easily be discharged from the opened side cover 5*a* of cover 5 to the outside by the blown air.

Cleaning can be performed under the above condition to more efficiently clean the cooling core.

While the present embodiment is described in connection with the configuration in which an operator can manually open side cover 5*a*, the operation is not limited to the manual operation. Specifically, for example, control can be performed so that side cover 5*a* is automatically opened in the case of the cleaning mode, which removes complexity of operation by the operator.

While the present embodiment has been described with reference to a bulldozer as an example of the work vehicle, the present invention is applicable as well to a work vehicle such as hydraulic excavator, wheel loader, and the like, and is applicable to any as long as it is a work machine provided with engine 4.

In the present embodiment, when fan 13 makes reverse rotation during execution of the idle reduction control, counting (counting the time) of the idle state for the sake of control is stopped so that engine 4 is prevented from being automatically stopped while fan 13 makes reverse rotation. Specifically, the above description is of the system in which whether or not fan 13 makes reverse rotation is determined before the idle state has continued for a predetermined time. In an alternative embodiment, whether or not fan 13 makes reverse rotation may be determined when the idle state has continued for a predetermined time during execution of the idle reduction control, and idle reduction control unit 51 may be configured not to output the engine stop signal to engine controller 42 if fan 13 makes reverse rotation.

In addition to the above embodiments, an embodiment may be configured in which counting (counting the time) of the idle state by idle reduction timer 56 may not be started when fan 13 is making reverse rotation, so that engine 4 is prevented from being automatically stopped during reverse rotation of fan 13.

While the foregoing is the description of the embodiments of the present invention, it should be construed that the embodiments disclosed herein are by way of illustration in all respects, not by way of limitation. It is intended that the scope of the present invention is defined by claims, not by the description above, and encompasses all modifications and variations equivalent in meaning and scope to the claims.

REFERENCE SIGNS LIST

1 bulldozer; 2 traveling unit; 3 body; 4 engine; 4*a* water pump; 4*b*, 11*a*, 12*a*, 14*a*, 15*a*, 31*a*, 32*a*, 35*a* conduit; 4*c* water jacket; 5 cover; 5*a* side cover; 6 cab; 7 blade; 7*a*, 8*a* hydraulic cylinder; 8 ripper; 10 cooling core; 11 radiator; 12 oil cooler; 13 fan; 14, 43 hydraulic pump; 14*b*, 31*b*, 14*b*, 31*b* servo valve; 14*c* electromagnetic proportional valve; 15 electromagnetic switch valve; 16 function switch; 17 hydraulic oil tank; 18 check valve; 19 operator seat; 20 controller; 20*a* storage unit; 21 coolant temperature sensor; 22 hydraulic oil temperature sensor; 23 engine rotation sensor; 24 right control device; 25 blade control lever; 26 ripper control lever; 27 left control device; 28 travel control lever; 29 lock lever; 30 function guide; 31 multigauge; 31*c* load sensing valve; 32 engine water temperature gauge; 33 hydraulic oil temperature gauge; 34 fuel gauge; 35 transmission oil temperature gauge; 36 energy saving gauge; 37 clock; 38 state indicator; 39*a* function display icon; 40 governor motor; 41 hydraulic motor; 42 engine controller; 44 fuel dial; 45 potentiometer; 46 starter switch; 47 control valve; 48 pressure reducing valve; 49 pilot pressure control valve; 50 fan control unit; 51 idle reduction control unit; 52 idle reduction time setting unit; 56 idle reduction timer; 57 idle reduction execution unit; 60 operation state detection unit; 100 control panel; 115 display; 310 vehicle body setting screen; 320 idle reduction time setting screen; 330 screen for other settings

The invention claimed is:

1. A work vehicle comprising:

an engine;

a cooling core mounted in the work vehicle;

a fan configured to blow air to said cooling core and to make regular and reverse rotations;

a hydraulic drive unit configured to drive said fan by driving said engine; and an idle reduction execution unit configured to stop said engine based on a state of rotation of said fan caused by said hydraulic drive unit and based on an idle state, said idle reduction execution unit stopping said engine on a condition that said fan makes regular rotation and said idle state has continued for a predetermined time, and not stopping said engine on a condition that said fan makes reverse rotation.

2. The work vehicle according to claim 1, further comprising:

a cab; and a control panel provided in said cab and configured to receive an instruction given by an operator to make reverse rotation of said fan, wherein said hydraulic drive unit drives said fan so that said fan makes reverse rotation, when said control panel receives said instruction to make reverse rotation of said fan.

3. The work vehicle according to claim 1, wherein said hydraulic drive unit includes:

a hydraulic motor configured to drive said fan;

a hydraulic pump configured to supply a hydraulic oil to said hydraulic motor by being driven by said engine;

a switch valve configured to switch a path through which said hydraulic oil is flown to said hydraulic motor; and an adjustment unit configured to adjust a supply amount of the hydraulic oil supplied from said hydraulic pump to said hydraulic motor.

4. The work vehicle according to claim 3, wherein rotation speed of the regular and reverse rotations of said fan is adapted to be variable depending on the supply amount of said hydraulic oil supplied from said hydraulic pump to said hydraulic motor, and said adjustment unit adjusts the supply amount of said hydraulic oil supplied from said hydraulic pump to said hydraulic motor so that the rotation speed of said fan is a maximum rotation speed in a case where said fan makes reverse rotation.

5. The work vehicle according to claim 1, further comprising a detection unit configured to detect a state of operation of said work vehicle, wherein said idle reduction execution unit stops said engine on a condition that said detection unit detects that the state of operation of said work vehicle is a state where said work vehicle is not operated, said fan makes regular rotation, and said idle state has continued for a predetermined time, and does not stop said engine on a condition that said fan makes reverse rotation.

6. The work vehicle according to claim 1, further comprising a sensor configured to detect a temperature of a coolant of said engine or a temperature of a hydraulic oil, and said idle reduction execution unit stops said engine on a condition that the temperature of the coolant of said engine or the temperature of the hydraulic oil detected by said sensor is in a predetermined range, said fan makes regular rotation, and said idle state has continued for a predetermined time, and does not stop said engine on a condition that said fan makes reverse rotation.

7. The work vehicle according to claim 1, further comprising a cover arranged to cover said engine, said cooling core, and said fan, wherein said cover includes a side cover capable of opening to expose a side of at least one of said engine, said cooling core, and said fan, when said fan makes reverse rotation.

* * * * *